US008393161B2

(12) United States Patent
Gruschka

(10) Patent No.: US 8,393,161 B2
(45) Date of Patent: Mar. 12, 2013

(54) COMBUSTION CHAMBER AND GAS TURBINE INSTALLATION

(75) Inventor: Uwe Gruschka, Kaarst (DE)

(73) Assignee: Siemens Aktiengesellschaft, München (DE)

( * ) Notice: Subject to any disclaimer, the term of this patent is extended or adjusted under 35 U.S.C. 154(b) by 827 days.

(21) Appl. No.: 11/992,530

(22) PCT Filed: Sep. 21, 2006

(86) PCT No.: PCT/EP2006/066602

§ 371 (c)(1),
(2), (4) Date: Mar. 25, 2008

(87) PCT Pub. No.: WO2007/036486

PCT Pub. Date: Apr. 5, 2007

(65) Prior Publication Data

US 2009/0133378 A1 May 28, 2009

(30) Foreign Application Priority Data

Sep. 27, 2005 (EP) ..... 05021085

(51) Int. Cl.
*F23D 14/78* (2006.01)
*F23R 3/60* (2006.01)

(52) U.S. Cl. ..... 60/796; 60/752; 60/756; 60/737; 60/800; 431/253

(58) Field of Classification Search ..... 60/752, 60/796, 39.821, 39.83, 756, 800, 737, 747, 60/722, 748; 431/253
See application file for complete search history.

(56) References Cited

U.S. PATENT DOCUMENTS

| | | | | |
|---|---|---|---|---|
| 4,322,945 | A | 4/1982 | Peterson et al. | |
| 5,894,732 | A * | 4/1999 | Kwan | 60/756 |
| 6,314,739 | B1 * | 11/2001 | Howell et al. | 60/748 |
| 6,546,733 | B2 * | 4/2003 | North et al. | 60/772 |
| 6,581,386 | B2 * | 6/2003 | Young et al. | 60/748 |
| 2003/0061815 | A1 * | 4/2003 | Young et al. | 60/748 |
| 2005/0016178 | A1 | 1/2005 | Wasif et al. | |

FOREIGN PATENT DOCUMENTS

EP 1 058 061 A1 12/2000

* cited by examiner

*Primary Examiner* — Ehud Gartenberg
*Assistant Examiner* — Steven Sutherland

(57) ABSTRACT

A combustion chamber having a burner and a burner insert surrounding the burner while leaving a gap open towards the combustion chamber interior is provided. The burner insert comprises a carrier and a burner insert wall located in front of the carrier towards the combustion chamber interior, wherein a flow passage connected to a cooling-fluid source is formed between the carrier and the burner insert wall. The flow passage opens out into the gap between the burner and the burner insert and is otherwise sealed off from the combustion chamber interior.

6 Claims, 2 Drawing Sheets

COMBUSTION CHAMBER AND GAS TURBINE INSTALLATION

CROSS REFERENCE TO RELATED APPLICATIONS

This application is the US National Stage of International Application No. PCT/EP2006/066602, filed Sep. 21, 2006 and claims the benefit thereof. The International Application claims the benefits of European application No. 05021085.5 filed Sep. 27, 2005, both of the applications are incorporated by reference herein in their entirety.

FIELD OF INVENTION

The present invention relates to a combustion chamber, in particular a combustion chamber for a gas turbine installation, with a burner and a burner insert, which surrounds the burner while leaving a gap that opens toward the combustion chamber interior. The present invention also relates to a gas turbine having such a combustion chamber.

BACKGROUND OF THE INVENTION

A gas turbine installation is a flow machine, essentially comprising a compressor section, a turbine section and a burner section with one or more combustion chambers disposed between the compressor section and the turbine section. During operation of the gas turbine installation ambient air is drawn in by the compressor and compressed to a higher pressure. The compressed air is supplied to the burner section, where it is combusted by means of a burner in a combustion chamber. The combustion waste gas, which is hot and at high pressure due to combustion, is finally supplied to the turbine section as a working medium, where it expands and cools as it works productively, with the energy of the working medium being converted to mechanical work. The energy converted to mechanical work in the turbine section serves on the one hand to drive the compressor and on the other hand to drive a consumer, for example a generator for generating electricity.

In modern gas turbine installations what is known as the premix combustion is generally used. In premix combustion the fuel is first mixed with an oxidation agent, generally air, before the mixture is ignited. During premix combustion a separate mass flow of fuel is also frequently used, being deployed to stabilize the flame and being referred to as the pilot fuel mass flow. The pilot fuel mass flow is fed in by way of a supply system that is separate from the main fuel supply. It serves to protect the flame against instabilities due to the thermo-acoustic response of the combustion process. A premix combustion, in which a pilot gas flow is used, is also referred to as piloted premix combustion. In piloted premix combustion the $NO_x$ emission of the combustion system is generally a function of the quantity of the pilot fuel mass flow supplied. The smaller the pilot fuel mass flow, the smaller too the $NO_x$ emission.

A combustion chamber with a burner configured for piloted premix combustion is described for example in US 2005/0016178 A1. The burner is surrounded by a burner insert, with an annular gap that opens toward the combustion chamber interior being present between the burner insert and the burner. The annular gap is sealed off from the combustion chamber exterior. The combustion chamber insert comprises a carrier and a burner insert wall located in front of the carrier toward the combustion chamber interior and at the same time forming the combustion chamber wall in the area of the burner. In order to be able to cool the burner insert wall, a cooling air duct is formed between the burner insert wall and the carrier, being supplied with cooling air from the combustion chamber exterior. This cooling air duct is sealed off from the annular gap between the burner insert and the burner. At the end of the burner insert away from the burner there is also an aperture to the combustion chamber interior, by way of which the cooling air flowing through the cooling air duct is discharged into the combustion chamber interior.

SUMMARY OF INVENTION

Compared with this prior art the object of the present invention is to provide an improved combustion chamber with a burner and a burner insert surrounding the burner.

A further object of the present invention is to provide an improved gas turbine installation.

The first object is achieved by a combustion chamber with a burner and a burner insert surrounding the burner. The second object is achieved by a gas turbine installation.

An inventive combustion chamber is fitted with a burner and a burner insert surrounding the burner. The burner insert can in particular be suitable for piloted premix combustion. A gap opening toward the combustion chamber interior is left between the burner and the burner insert. The burner insert comprises a carrier and a burner insert wall located in front of the carrier toward the combustion chamber interior, between which a flow duct, with a first end and a second end, connected to a cooling fluid source is formed. The flow duct opens into the gap at the second end between the burner and the burner insert and is also sealed off from the combustion chamber interior at the first end.

The inventive configuration of the combustion chamber allows cooling fluid used to cool the burner insert wall, which generally also forms the combustion chamber wall, to be fed into the gap between the burner and the burner insert. This means that cooling fluid, generally cooling air, can be introduced directly at the burner outlet. Introducing cooling fluid into the combustion chamber in direct proximity to the burner outlet allows an improvement to be achieved in the thermo-acoustic response of the combustion waste gases in the combustion chamber. The improvement in the thermo-acoustic response means that the quantity of pilot gas can be decreased, resulting in a reduction of $NO_x$ emissions.

In contrast, in the prior art as described in the introduction it is not possible, due to the ducting of the cooling air away from the burner, to feed the cooling air into the combustion chamber in proximity to the burner aperture.

Structurally speaking the burner insert wall is generally secured to the carrier by means of a rib engaging in a groove on the carrier in the area of the flow duct. In order to open the flow duct at the gap between the burner and the burner insert, in this instance the rib has at least one through-aperture allowing the passage of cooling fluid, for example at least one hole.

In a further refinement of the inventive combustion chamber the carrier has cooling fluid ducts, which are connected indirectly or directly to the cooling fluid source and open into the flow duct. However structural refinements are also possible, which direct the flow of cooling fluid past the carrier into the flow duct. Both refinements can also be combined with each other.

In the event that the gap between the burner and the burner insert is not closed off structurally at any point from the combustion chamber plenum, a seal sealing off the gap from the combustion chamber plenum is present between the burner and the burner insert. This prevents cooling fluid bypassing the flow duct and flowing into the gap between the burner and the burner insert.

The inventive combustion chamber can in particular be embodied as an axially symmetrical annular combustion chamber with a number of burners distributed about the axis of symmetry and at least one burner insert.

In a further refinement of the inventive combustion chamber the burner insert wall of a burner insert has at least one abutting edge, at which it adjoins an abutting edge of an adjacent burner insert or a combustion chamber wall. A seal is then present between the abutting edges of adjacent burner inserts and/or between the abutting edge and the combustion chamber wall, said seal sealing the burner insert wall off from the combustion chamber interior. This makes it possible to prevent the cooling fluid flowing through the flow duct flowing instead into the combustion chamber through the gap between the burner and the burner insert, through gaps between adjacent burner inserts or between a burner insert and the combustion chamber wall.

An inventive gas turbine installation is fitted with an inventive combustion chamber.

BRIEF DESCRIPTION OF THE DRAWINGS

Further features, characteristics and advantages of the present invention will emerge from the description which follows of an exemplary embodiment with reference to the accompanying figures, in which.

DETAILED DESCRIPTION OF INVENTION

Figure 1:
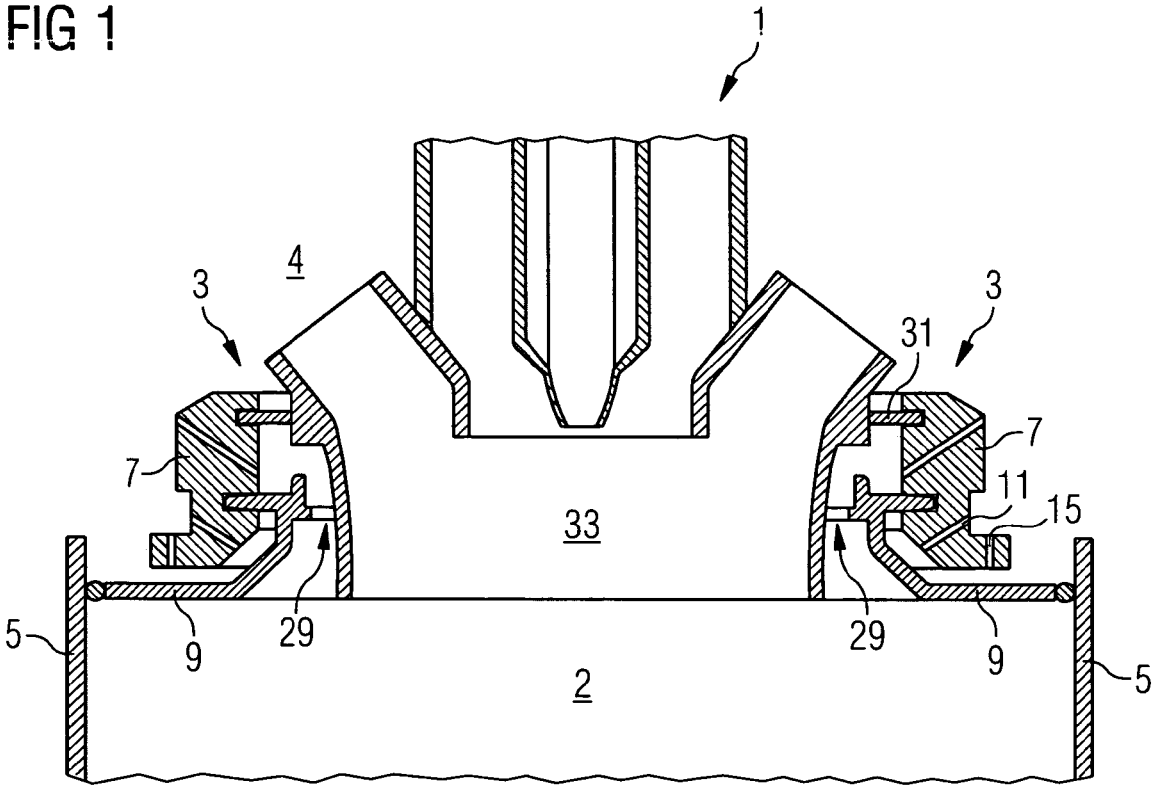
FIG. 1 shows a section from an inventive combustion chamber with a burner and a burner insert.

A sectional view of a section from an inventive combustion chamber is shown in FIG. 1. It shows a burner 1, a burner insert 3, which surrounds the burner 1 in an annular manner, and part of the combustion chamber wall 5. The combustion chamber is disposed in a combustion chamber plenum 4 and extends in an annular manner about a turbine shaft (not shown). The burner 1 is inserted into a holder in the burner insert 3. The burner insert 3 adjoins the combustion chamber wall 5 and closes off the combustion chamber.

The burner insert 3 comprises a carrier 7, configured as a grooved ring. In it one or more annular grooves run around the burner 1, through which cooling air can be supplied to the burner 1. The grooves are not shown for the sake of clarity.

A burner insert wall 9 is located in front of the grooved ring 7 toward the combustion chamber interior 2 and at the same time represents the closing wall of the combustion chamber 1 surrounding the burner 1. The burner insert wall 9 has a peripheral stud 23, with which the wall is inserted into a groove 21 of the grooved ring 7 and retained there. The side of the burner insert wall 9 facing away from the combustion chamber interior 2 can be blown with cooling air through holes 11, 15 in the grooved ring 7, in order to bring about impact cooling.

Figure 3:
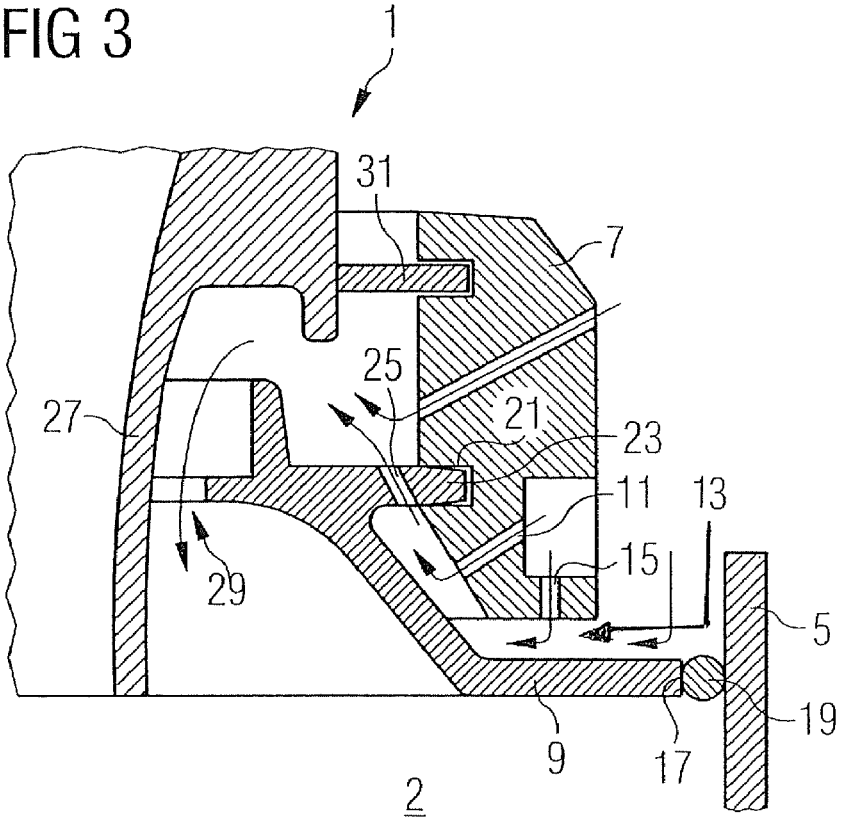
FIG. 3 shows a detailed section from FIG. 1.

The grooved ring 7, the burner insert wall 9 and a section of the combustion chamber wall 5 and a section of the burner 1 are shown enlarged in FIG. 3. A flow duct 13 is formed between the grooved ring 7 and the burner insert wall 9, to which cooling air is supplied as the cooling fluid from the combustion chamber plenum 4. In this sense the combustion chamber plenum 4 can be seen as a cooling fluid source. The flow paths of the cooling air are shown by arrows in FIG. 3.

Holes 11, 15 are present in the grooved ring 7, through which cooling air can be blown onto the burner insert wall 9, to bring about impact cooling of the burner insert wall 9. To prevent the cooling air flowing into the combustion chamber interior 2 in the area of the abutting edge 17, with which the burner insert wall 9 adjoins the combustion chamber wall 5, a seal 19 is disposed between the abutting edge and the combustion chamber wall 5. The seal is preferably flexible, in order to be able to compensate for thermal expansion. It can be produced as metal for example.

The stud 23, which retains the burner insert wall 9 in the retaining groove 21 of the grooved ring 7 has holes 25, which allow the cooling air to flow to the burner 1. The cooling air is deflected off the burner wall 7 in the direction of the interior of the combustion chamber and flows through the annular gap 29 between the burner wall 27 and the burner insert wall 9 into the interior 2 of the combustion chamber.

The intermediate space between the burner 1 and the burner insert 3 is sealed off from the combustion chamber plenum 4 by a piston ring 31 serving as a seal.

In the inventive combustion chamber the cooling air drawn in to cool the burner insert wall 9 flows into the combustion chamber through an annular gap 29 directly adjacent to the burner outlet 33 and is supplied to the combustion process. This improves the thermo-acoustic response of the combustion chamber, thereby allowing the quantity of pilot gas supplied to be decreased and therefore $NO_x$ emissions to be reduced.

Figure 2:
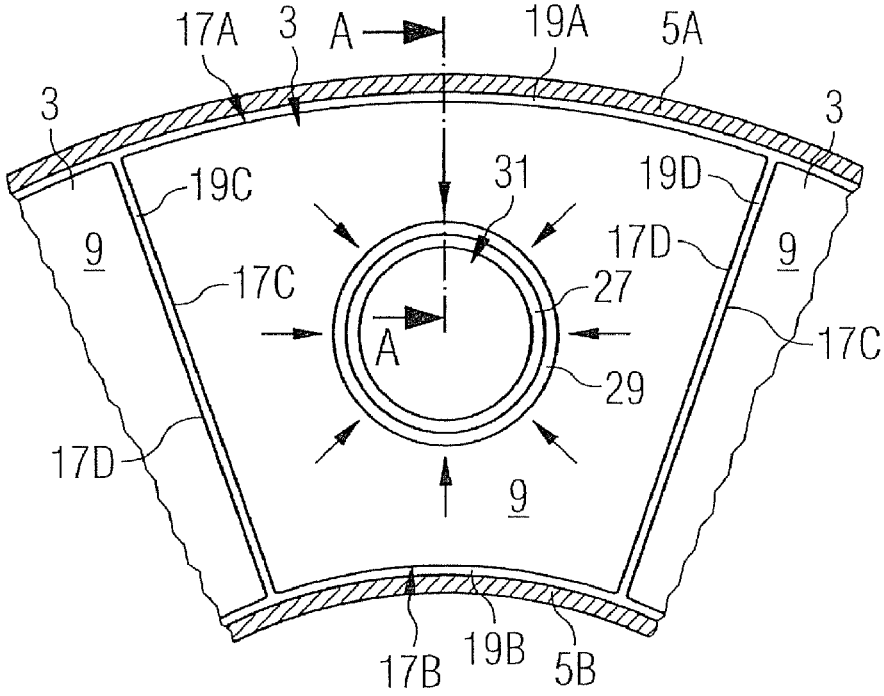
FIG. 2 shows a schematic top view of the burner insert from FIG. 1.

FIG. 2 shows a top view of the burner insert 3 and the burner 1 from the combustion chamber interior. Arrows show the flow paths of the cooling air along the combustion chamber insert wall 9.

The burner wall 27 surrounding the burner aperture 33 is visible in the center of the burner insert 3. Between the burner insert wall 9 and the burner wall 27 is the annular gap 29, through which the cooling air used to cool the burner insert wall 9 flows into the combustion chamber interior 2. The combustion chamber shown in FIG. 2 is an annular combustion chamber, which is disposed with axial symmetry about a turbine wheel. The figure shows the radially external combustion chamber wall 5A and the radially internal combustion chamber wall 5B. Seals 19A and 19B are present between the combustion chamber walls 5A, 5B and the abutting edges 17A, 17B of the burner insert wall 9 facing the combustion chamber walls 5A, 5B, said seals 19A and 19B sealing the flow duct of the combustion chamber insert 3 off from the combustion chamber interior 2.

In the present exemplary embodiment a separate burner insert 3 is present for every burner 1. The burner inserts 3 adjoin each other in the peripheral direction of the combustion chamber. Gaps between opposing abutting edges 17C, 17D of burner insert walls 9 of adjacent burner inserts 3 are also sealed off by seals 19C, 19D from the combustion chamber interior, to prevent cooling air from flowing out through these gaps. Alternatively however it is also possible to provide a single annular burner insert with a number of burner holders.

Finally it should be noted that the mass air flow supplied to the combustion chamber interior 2 through the flow duct 13 only corresponds to a few percent of the mass air flow supplied through the burner 1. The mass air flow supplied through the flow duct 13 is preferably less than approx. 5% of the mass air flow supplied through the burner 1.

The invention has been described with reference to an annular combustion chamber but the combustion chamber can also be configured as a roughly cylindrical combustion chamber with at least one burner and at least one burner insert on the end face of the cylinder.

The invention claimed is:

1. A combustion chamber, comprising:

a burner:

a burner insert surrounding the burner and arranged to leave a gap opening toward an interior of the combustion chamber, wherein the burner insert has a carrier, and a burner insert wall arranged between the carrier and the combustion chamber interior that forms a flow duct, with a first end and a second end, between the carrier and the burner insert wall where the flow duct is connected to a cooling fluid source at the first end, the flow duct directly abuts the burner insert wall; and a burner outlet, wherein the flow duct opens into the gap at the second end between a burner wall and the burner insert wall and is also sealed off from the combustion chamber interior at the first end, wherein cooling air from the cooling fluid source flowing in the flow duct from the first end to the second end and is used to cool the burner insert wall, and subsequently flows through the gap directly adjacent to the burner outlet and is then supplied to the combustion chamber interior, and wherein the carrier includes cooling fluid holes connected to the cooling fluid source and open into the flow duct.

2. The combustion chamber as claimed in claim 1, wherein the burner insert wall is secured to the carrier by a rib engaged in a groove on the carrier in the area of the flow duct and the rib has a through-aperture allowing the passage of cooling fluid.

3. The combustion chamber as claimed in claim 2, wherein a through-aperture is a hole through the rib.

4. The combustion chamber as claimed in claim 3, wherein a seal sealing off the gap from a combustion chamber plenum is present between the carrier and the burner.

5. The combustion chamber as claimed in claim 4, wherein the combustion chamber is an axially symmetrical annular combustion chamber having a plurality of burners and a burner inserts distributed about an axis of symmetry.

6. The combustion chamber as claimed in claim 5, wherein the burner insert wall of the burner insert has an abutting edge, that adjoins an abutting edge of an adjacent burner insert or a combustion chamber wall and that a seal is present between the abutting edges of adjacent burner inserts and/or between the abutting edge and the combustion chamber wall, to seal the burner insert wall off from the combustion chamber interior.

* * * * *